US009228423B2

(12) United States Patent
Powell et al.

(10) Patent No.: US 9,228,423 B2
(45) Date of Patent: Jan. 5, 2016

(54) SYSTEM AND METHOD FOR CONTROLLING FLOW IN A WELLBORE

(75) Inventors: Reinhard Powell, Pearland, TX (US); Jerome Prost, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 949 days.

(21) Appl. No.: 13/209,221

(22) Filed: Aug. 12, 2011

(65) Prior Publication Data

US 2012/0067593 A1 Mar. 22, 2012

Related U.S. Application Data

(60) Provisional application No. 61/384,982, filed on Sep. 21, 2010.

(51) Int. Cl.

| | |
|---|---|
| ***E21B 34/06*** | (2006.01) |
| ***E21B 43/12*** | (2006.01) |
| ***E21B 43/10*** | (2006.01) |
| ***E21B 34/10*** | (2006.01) |

(52) U.S. Cl.
CPC ..... *E21B 43/12* (2013.01); *E21B 34/066* (2013.01); *E21B 34/10* (2013.01); *E21B 43/10* (2013.01)

(58) Field of Classification Search
CPC ..... E21B 34/066; E21B 43/12; E21B 43/10
USPC ..... 166/66.4, 66.6, 72, 373, 375
See application file for complete search history.

(56) References Cited

U.S. PATENT DOCUMENTS

| | | | | |
|---|---|---|---|---|
| 3,970,034 | A | 7/1976 | Kirk | |
| 4,636,934 | A | 1/1987 | Schwendemann et al. | |
| 4,942,926 | A * | 7/1990 | Lessi | 166/385 |
| 5,832,996 | A | 11/1998 | Carmody et al. | |
| 6,279,651 | B1 | 8/2001 | Schwendemann et al. | |
| 6,786,285 | B2 | 9/2004 | Johnson et al. | |
| 7,195,033 | B2 * | 3/2007 | Mayeu et al. | 137/554 |
| 7,387,165 | B2 * | 6/2008 | Lopez de Cardenas et al. | 166/313 |
| 7,954,552 | B2 * | 6/2011 | Mandrou et al. | 166/375 |
| 8,360,158 | B2 * | 1/2013 | Mandrou et al. | 166/375 |
| 2006/0196660 | A1 | 9/2006 | Patel | |
| 2007/0163774 | A1 | 7/2007 | Hosatte et al. | |
| 2009/0014168 | A1 | 1/2009 | Tips et al. | |
| 2009/0050333 | A1 | 2/2009 | Smith et al. | |
| 2009/0283276 | A1 | 11/2009 | Mandrou et al. | |
| 2010/0038093 | A1 | 2/2010 | Patel | |

FOREIGN PATENT DOCUMENTS

| | | | |
|---|---|---|---|
| WO | 9809055 | A1 | 3/1998 |
| WO | 9947790 | A1 | 9/1999 |

OTHER PUBLICATIONS

PCT/US2011/052255, International Search Report and Written Opinion, Jun. 19, 2012, 12 pages.

* cited by examiner

*Primary Examiner* — Nicole Coy
(74) *Attorney, Agent, or Firm* — David J. Groesbeck

(57) ABSTRACT

A technique facilitates controlling flow in a wellbore. One or more flow control valve assemblies may be designed for coupling with downhole well equipment. Each flow control valve assembly comprises a flow control valve which cooperates with a control module. The control module comprises a plurality of electrically controlled valves arranged to control flow of actuating fluid to the flow control valve. Each flow control valve assembly also comprises a hydraulic override system to enable hydraulic actuation of the flow control valve to a predetermined position when, for example, no electrical power is available for the electrically controlled valves of the control module.

18 Claims, 8 Drawing Sheets

SYSTEM AND METHOD FOR CONTROLLING FLOW IN A WELLBORE

CROSS-REFERENCE TO RELATED APPLICATION

The present document is based on and claims priority to U.S. Provisional Application Ser. No. 61/384,982, filed Sep. 21, 2010, incorporated herein by reference.

BACKGROUND

Hydrocarbon fluids, e.g. oil and natural gas, are obtained from a subterranean geologic formation, referred to as a reservoir, by drilling a well that penetrates the hydrocarbon-bearing formation. Once a wellbore is drilled, various forms of well completion components may be installed to control and enhance the efficiency of producing fluids from the reservoir. One piece of equipment which may be installed is a flow control valve. Typically, flow control valves allow a variety of positions between full open and full close. To achieve this, a control module may be used to incrementally displace an annular choke which is adjusted to control the production or injection of reservoir fluids.

SUMMARY

In general, the present invention provides a technique for controlling flow in a wellbore. One or more flow control valve assemblies may be designed for coupling with downhole well equipment. Each flow control valve assembly comprises a flow control valve which cooperates with a control module. The control module comprises a plurality of electrically controlled valves arranged to control flow of actuating fluid to the flow control valve. Each flow control valve assembly also comprises a hydraulic override system to enable hydraulic actuation of the flow control valve to a predetermined position when, for example, no electrical power is available for the electrically controlled valves of the control module.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
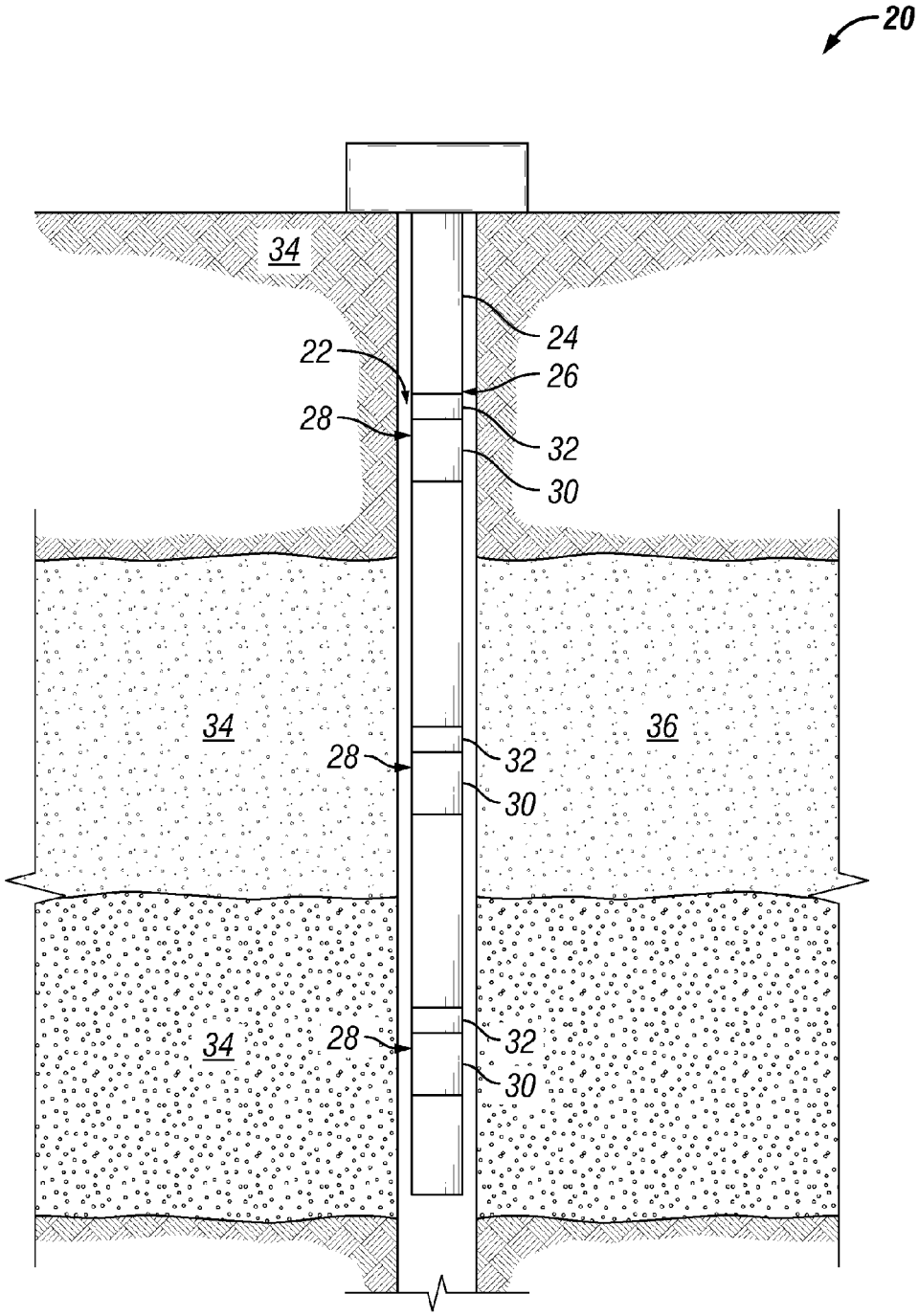
FIG. 1 is a schematic illustration of a well system deployed in a wellbore and including a plurality of flow control valve assemblies, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The disclosure herein generally relates to a system and methodology for controlling fluid flow in a wellbore. For example, the system and methodology may relate generally to well completion systems and components, including tubing strings having one or more flow control valve assemblies. In some applications, a plurality of flow control valve assemblies is employed to control flow from or into specific well zones along the wellbore. Each of the flow control valve assemblies may comprise a flow control valve coupled with a control module, such as an electro-hydraulic control module, used to control the opening or closing of the flow control valve. In at least some applications, the control module is used to control a variable actuation position of the flow control valve to selectively control the rate of flow through the flow control valve.

In some embodiments, for example, the control module is used to incrementally displace a piston or other actuator, e.g. a choke, in a corresponding flow control valve. Displacement of the actuator increases or decreases the injection or production flow rates of fluids into or out of a surrounding reservoir. With multiple flow control valve assemblies, the flow rate of fluids into or out of multiple well zones may be independently controlled.

By way of example, the control module may be controlled using a plurality, e.g. two, hydraulic control lines and an electrical line. In some embodiments, the electrical line comprises individual wires. By applying a current greater than a current threshold to a particular subset of wires, solenoid valves or other electrically operated valves may be individually operated within specific control modules. For example, actuation of a specific solenoid valve controls flow of actuating fluid to the actuator, e.g. piston, of the flow control valve. The actuator moves in a given direction when a pressure greater than a pressure threshold is applied through a first hydraulic line. The actuator stops moving if the current is decreased below the current threshold on this particular subset of wires regardless of how much hydraulic pressure is on the first hydraulic control line.

The actuator of the flow control valve can be made to move in an opposite direction if current greater than a current threshold is applied to another subset of wires to operate a second electrically operated valve, e.g. a solenoid valve. Actuation of the second electrically operated valve causes movement of the flow control valve actuator by fluid pressurized in the first hydraulic line at a pressure level greater than a given pressure threshold in the first hydraulic line. The control modules also comprise a hydraulic override system which allows actuation of the corresponding flow control valve or valves when no electrical power is available at the control module. For example, hydraulic pressure may be applied to a control module or modules at a pressure greater than a second pressure threshold of a second hydraulic line to cause a desired movement of the actuator within the corresponding flow control valve or valves. When sufficient pressure is applied to the second hydraulic line, no current is required on the wires in the electrical line.

Referring generally to FIG. 1, an embodiment of a well system 20 for controlling flow of fluid in a wellbore 22 is illustrated. In this embodiment, well system 20 comprises a tubing string 24 which may include a variety of downhole equipment 26. The tubing string 24 and downhole equipment 26 further comprising a plurality of flow control valve assemblies 28. Each flow control valve assembly 28 comprises a flow control valve 30 coupled to a corresponding control module 32, such as an electro-hydraulic control module. The flow control valve assemblies 28 may be used to control the inflow of reservoir fluid or the outflow of injection fluid with respect to a plurality of well zones 34 in a surrounding reservoir 36. It should be noted that downhole equipment 26 may comprise a variety of packers and other equipment designed to isolate the various well zones 34 along wellbore 22.

Figure 2:
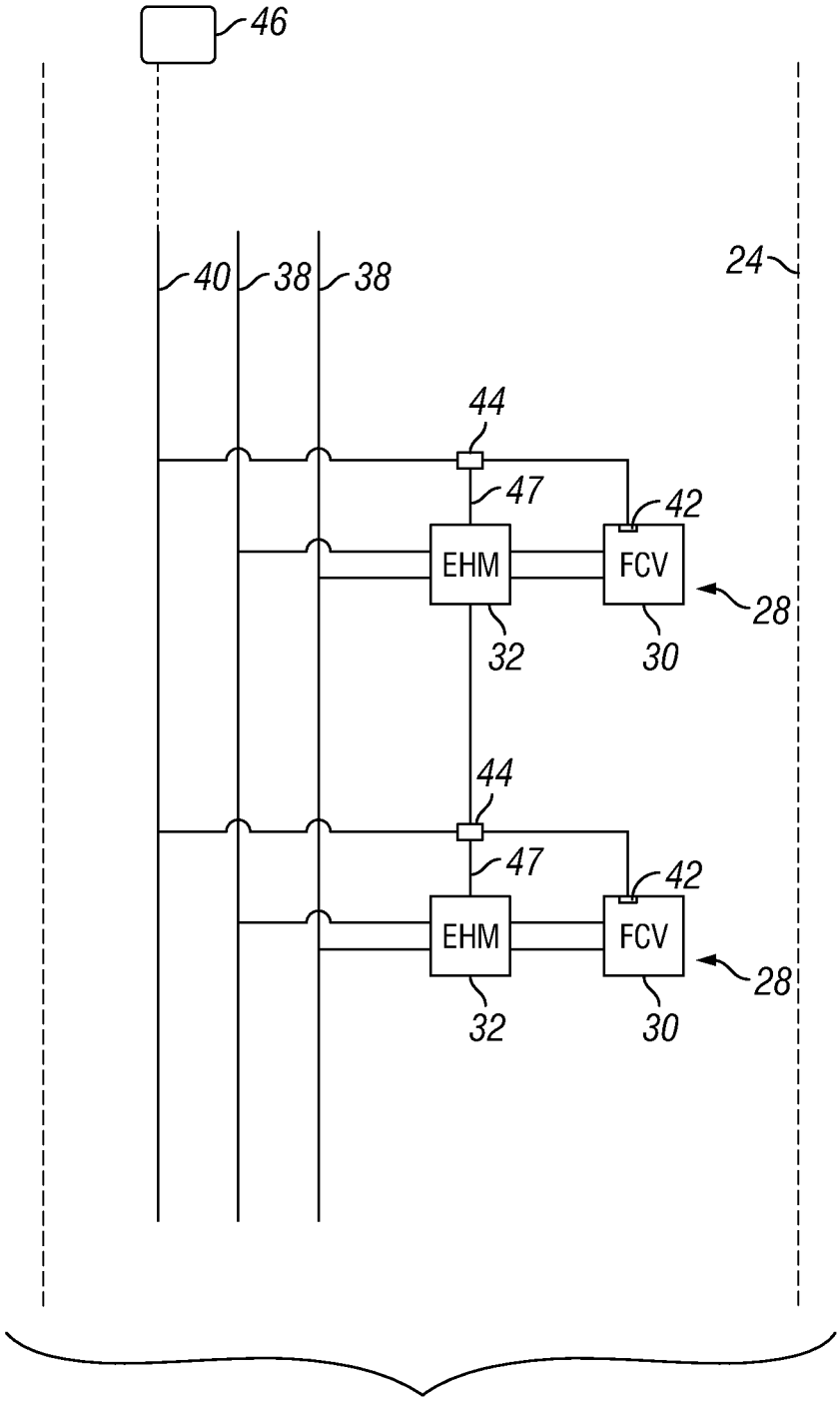
FIG. 2 is a schematic example of one type of well system having a plurality of flow control valve assemblies, according to an embodiment of the present invention.

Referring also to FIG. 2, a schematic illustration is provided to show one embodiment of well system 20 which utilizes a plurality of hydraulic lines 38 and an electrical line 40. The hydraulic lines 38 and the electrical line 40 are coupled to the plurality of control modules 32 in a manner designed to enable individual control over the corresponding flow control valves 30. In this specific example, each control module 32 is an electro-hydraulic module coupled to two hydraulic lines 38 and to electrical line 40. By way of example, each control module 32 is actuated to selectively control the corresponding flow control valve 30 via flow of hydraulic actuating fluid flowing through hydraulic lines 38. For example, hydraulic actuating fluid may flow from a first hydraulic line 38 and through a first configuration of the control module 32 to actuate flow control valve 30 toward a closed position. The control module 32 also may be transitioned to a second configuration allowing hydraulic actuating fluid to flow from the first hydraulic line 38 to flow control valve 30 so as to actuate the flow control valve 30 toward an open position. Each control module 32 is readily controlled to enable the desired incremental actuation of the corresponding flow control valve 30 between closed and open positions.

In the embodiment illustrated, each flow control valve 30 comprises a sensor 42 which monitors the actuation position of the flow control valve. For example, sensors 42 may comprise position sensors which track the position of an actuator within each flow control valve 30. Each sensor 42 may be coupled with corresponding electronics 44 which, in turn, are coupled to electrical line 40 or another suitable transmission line. The electronics 44 convey data from the sensors 42 to an appropriate control system 46, such as a processor-based control system. The control system 46 may be used to provide suitable inputs to each of the electro-hydraulic modules 32 so as to ensure the desired actuation of a corresponding flow control valve 30. By way of example, the control system 46 may be located at a surface location. However, other embodiments may position control system 46, in whole or in part, within the electronics 44 and/or at other downhole locations. As described above, the control modules 32 may be individually controlled by applying a current greater than a current threshold to a particular subset of wires in electrical line 40 to cause individual operation of solenoid valves (or other electrically operated valves) within specific control modules. As illustrated in FIG. 2, however, the electrical line 40 may be coupled to the electronics modules 44 associated with electro-hydraulic modules 32 and each electronics module 44 may be coupled to the corresponding module 32 via a communication line 47. Control signals are sent through electrical line 40 to electronics 44 which, in turn, provide the appropriate signals to the respective module 32.

Figure 3:
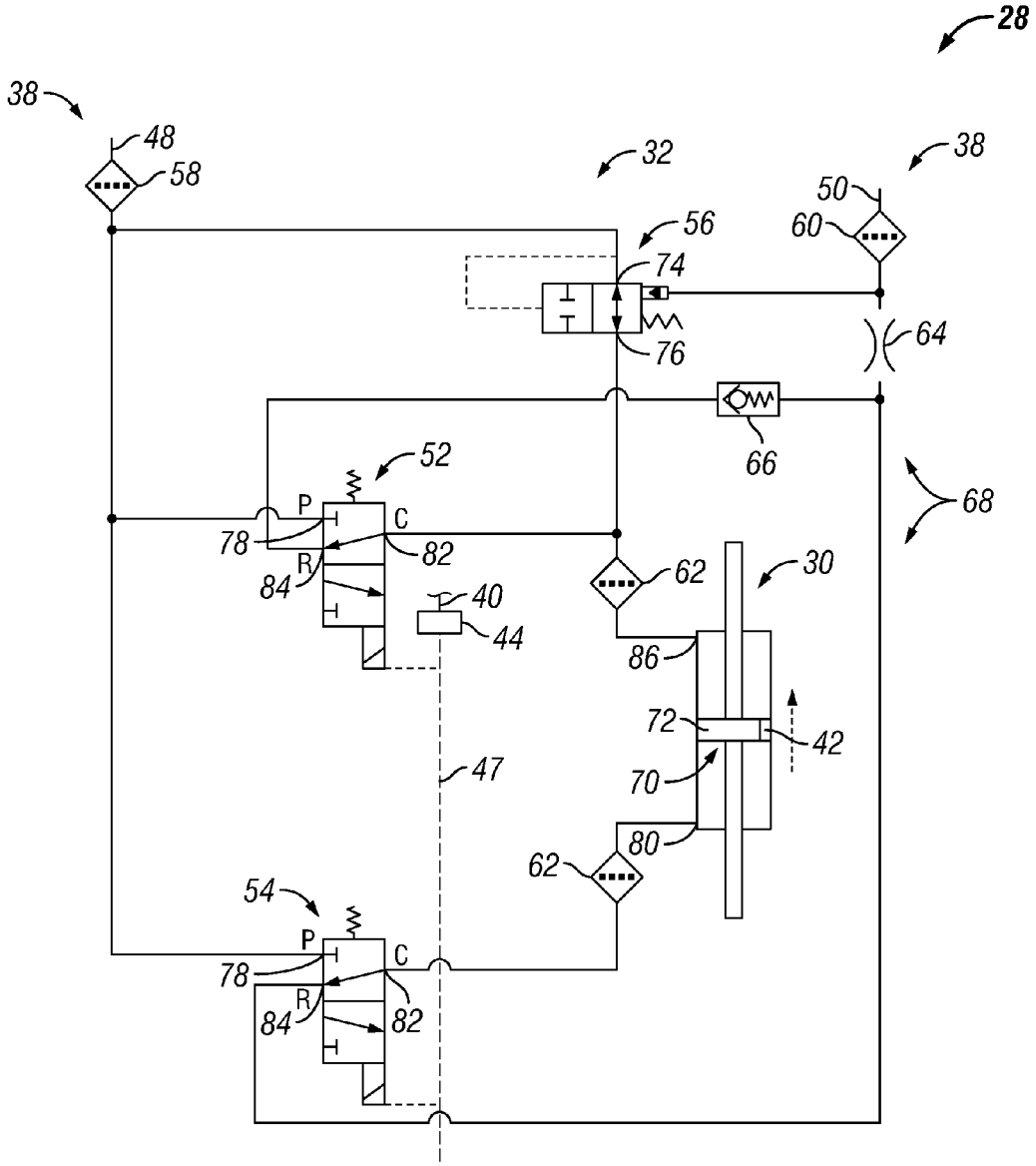
FIG. 3 is a schematic example of a control module, e.g. an electro-hydraulic control module, coupled to a flow control valve, according to an embodiment of the present invention.

In FIG. 3, an example of one of the control modules 32 is illustrated in schematic form as coupled with its corresponding control valve 30. The control module 32 also is coupled to hydraulic lines 38 and to electrical line 40 via electronics 44. For purposes of explanation, one of the hydraulic lines 38 has been labeled a first hydraulic line 48 while the other hydraulic line 38 has been labeled a second hydraulic line 50. It should be noted that two hydraulic lines have been illustrated, but certain embodiments may employ additional hydraulic lines.

As illustrated, first hydraulic line 48 and second hydraulic line 50 are each connected to a plurality of electrically operated valves, e.g. valves 52, 54, within control module 32. By way of example, the plurality of electrically operated valves 52, 54 may comprise solenoid valves. The specific embodiment illustrated employs two electrically operated valves 52, 54 although additional electrically operated valves or other combinations of electrically operated valves may be used to achieve the same or similar functionality. The electrically operated valves 52, 54 are coupled with electrical line 40 via electronics 44 and receive control signals through electrical line 40 and electronics 44 to enable controlled shifting of valves 52, 54 to desired operational configurations. If valves 52, 54 are solenoid valves, for example, current may be supplied via electrical line 40 and electronics 44 to energize or de-energize the appropriate solenoid. The first hydraulic line 48 and the second hydraulic line 50 also may be coupled to an additional valve 56, such as a hydraulically actuated valve, which cooperates with the electrically operated valves 52, 54 to control actuation of flow control valve 30 and to enable hydraulic override as described in greater detail below. The control module valve 56 is in a normally open position, as illustrated in FIG. 3.

Depending on the specific application, each control module 32 may comprise a variety of other features and components. For example, the first hydraulic line 48 may be coupled with electrically operated valves 52, 54 and with the additional valve 56 across a filter 58. Similarly, the second hydraulic line 50 may be coupled with electrically operated valves 52, 54 and with the additional valve 56 across a filter 60. Additional filters 62 may be located in the hydraulic fluid flow path between control module valves 52, 54, 56 and the flow control valve 30. Additional features may comprise one or more flow restrictors 64 and one or more check valves 66 appropriately positioned along the path to the second hydraulic line 50.

In the embodiment illustrated, control module 32 also is constructed with a component arrangement providing a hydraulic override system 68. The hydraulic override system 68 allows actuation of the corresponding flow control valve 30 without electrical power, e.g. when no electrical power is available to the control module 32. For example, hydraulic pressure may be applied to the control module 32 via second hydraulic line 50 at a pressure greater than the pressure threshold of the second hydraulic line to cause a desired actuation of flow control valve 30. In some embodiments, the flow control valve 30 may be actuated to an open flow position by the hydraulic override system 68.

Figure 4:
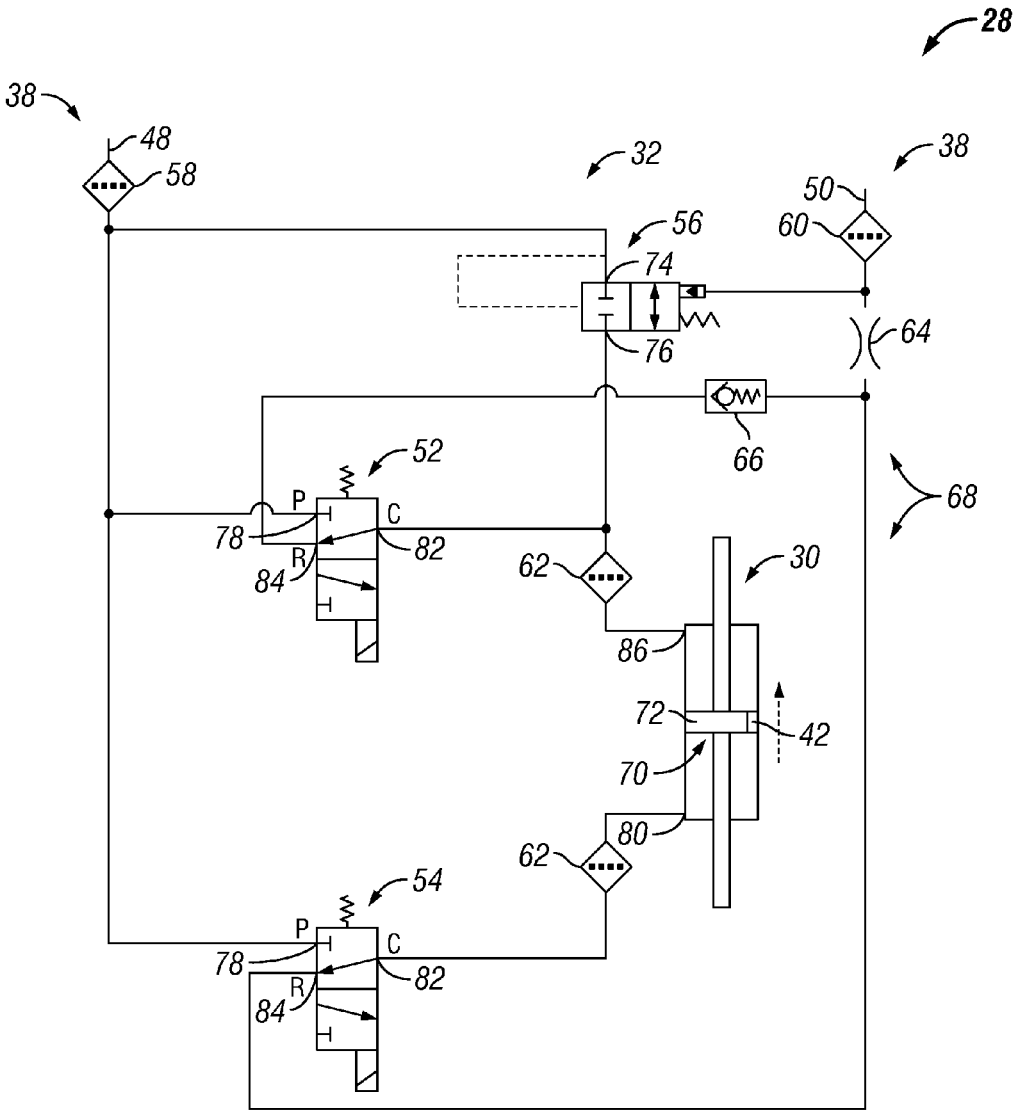
FIG. 4 is a schematic illustration of the control module in FIG. 3 but in another operational configuration, according to an embodiment of the present invention.

In FIG. 3, the flow control valve 30 is illustrated as having an actuator 70 which may be moved between an open flow position and a closed flow position to achieve the desired fluid flow rate from or to the corresponding well zone 34. By way of example, the actuator may comprise a flow control valve piston 72. In some embodiments, the position sensor 42 may be mounted at least in part on the actuator 70, e.g. on piston 72. To use the control module 32 to actuate flow control valve 30, e.g. to move flow control valve piston 72, a hydraulic pressure is initially applied to the first hydraulic line 48. The pressure state of the electro-hydraulic control module 32 following application of pressure to first hydraulic line 48 is illustrated in FIG. 4. Once sufficient hydraulic pressure has been applied to first hydraulic line 48, the normally open valve 56 is shifted to a closed position, as illustrated. When closed, valve 56 prevents pressure communication between a first port 74 and a second port 76 of the control module valve 56. Additionally, pressure is blocked at pressure ports 78 of both electrically operated valves 52 and 54, e.g. both solenoid valves.

Figure 5:
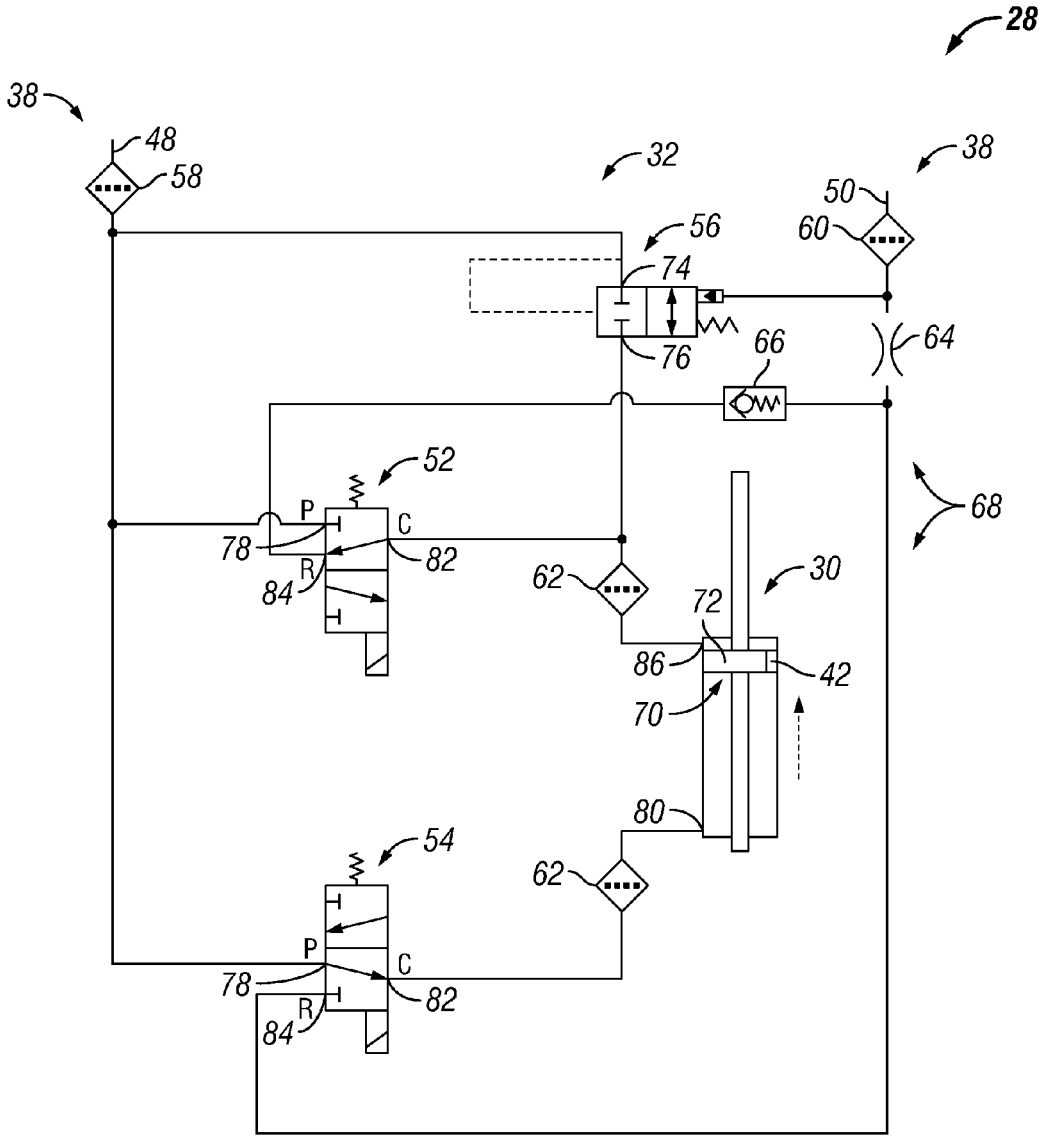
FIG. 5 is a schematic illustration of the control module in FIG. 3 but in another operational configuration, according to an embodiment of the present invention.

To move actuator 70 of flow control valve 30 in an opening direction, the electrically operated valve 54 is energized via application of current through electrical line 40 and corresponding electronics 44. In some applications, the current for a specific electrically operated valve may be supplied on an appropriate subset of wires in electrical line 40. The pressure state of the control module 32 while the electrically operated valve 54 is energized is illustrated in FIG. 5. Hydraulic pressure from the first hydraulic line 48 is communicated to an opening side port 80 of flow control valve 30 via flow through port 78 and out through port 82 of electrically operated valve 54. The flow of sufficiently pressurized hydraulic fluid through module valve 54 and into the flow control valve 30 forces actuator 70 to move in an opening direction. As the actuator 70 moves toward increased opening, the volume of hydraulic fluid on the closing side of the flow control valve actuator 70 vents to the second hydraulic line 50 through port 82 and port 84 of the other electrically operated valve 52. After passing through module valve 52, the vented hydraulic fluid also flows through check valve 66 and flow restrictor 64.

Figure 6:
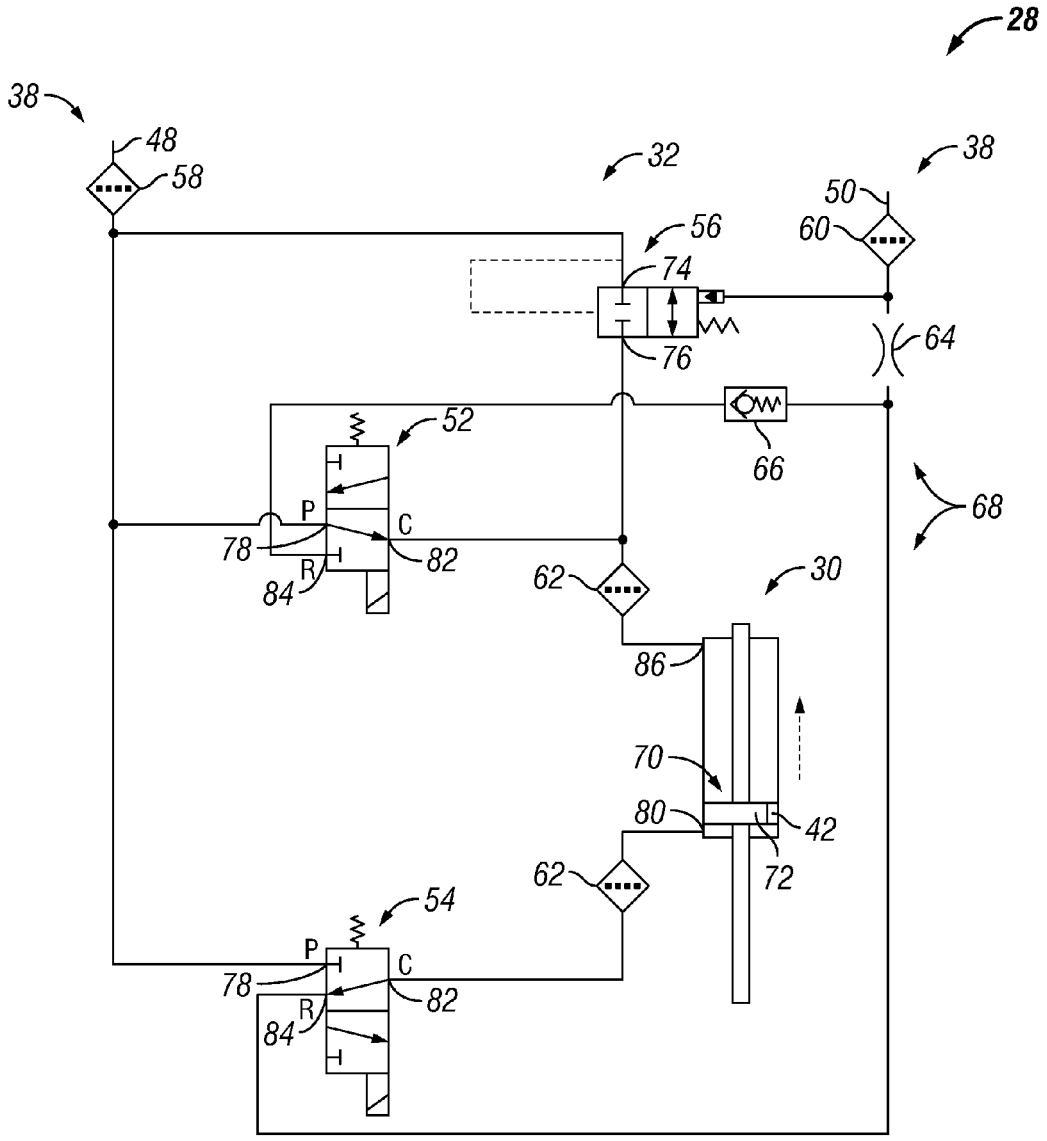
FIG. 6 is a schematic illustration of the control module in FIG. 3 but in another operational configuration, according to an embodiment of the present invention.

The flow control valve actuator 70, e.g. piston 72, continues to move toward the fully open position as long as the electrically operated valve 54 remains energized. Once the module valve 54 is de-energized, the actuator 70 stops moving and the pressure state returns to the pressure state illustrated in FIG. 4 regardless of the amount of pressure in first hydraulic line 48. To actuate the flow control valve actuator 70 in a closing direction, the electrically operated valve 52 is energized via application of current through electrical line 40 and electronics 44. The pressure state of control module 32 while the electrically operated valve 52 is energized is illustrated in FIG. 6. Hydraulic pressure from the first hydraulic line 48 is communicated to a closing side port 86 of flow control valve 30 via flow through port 78 and out through port 82 of electrically operated valve 52. The flow of hydraulic fluid through module valve 52 and into the flow control valve 30 forces actuator 70 to move in a closing direction.

As the actuator 70 moves in the closing direction, the volume of hydraulic fluid on the opening side of the flow control valve actuator 70 vents to second hydraulic line 50 through port 82 and port 84 of the other electrically operated valve 54. After passing through module valve 54, the vented hydraulic fluid also flows through flow restrictor 64. The flow control valve actuator 70 continues to move toward the closed position as long as the electrically operated valve 52 remains energized. However, once the module valve 52 is de-energized, the actuator 70 stops moving and the electro-hydraulic control module 32 returns to the pressure state illustrated in FIG. 4.

Figure 7:
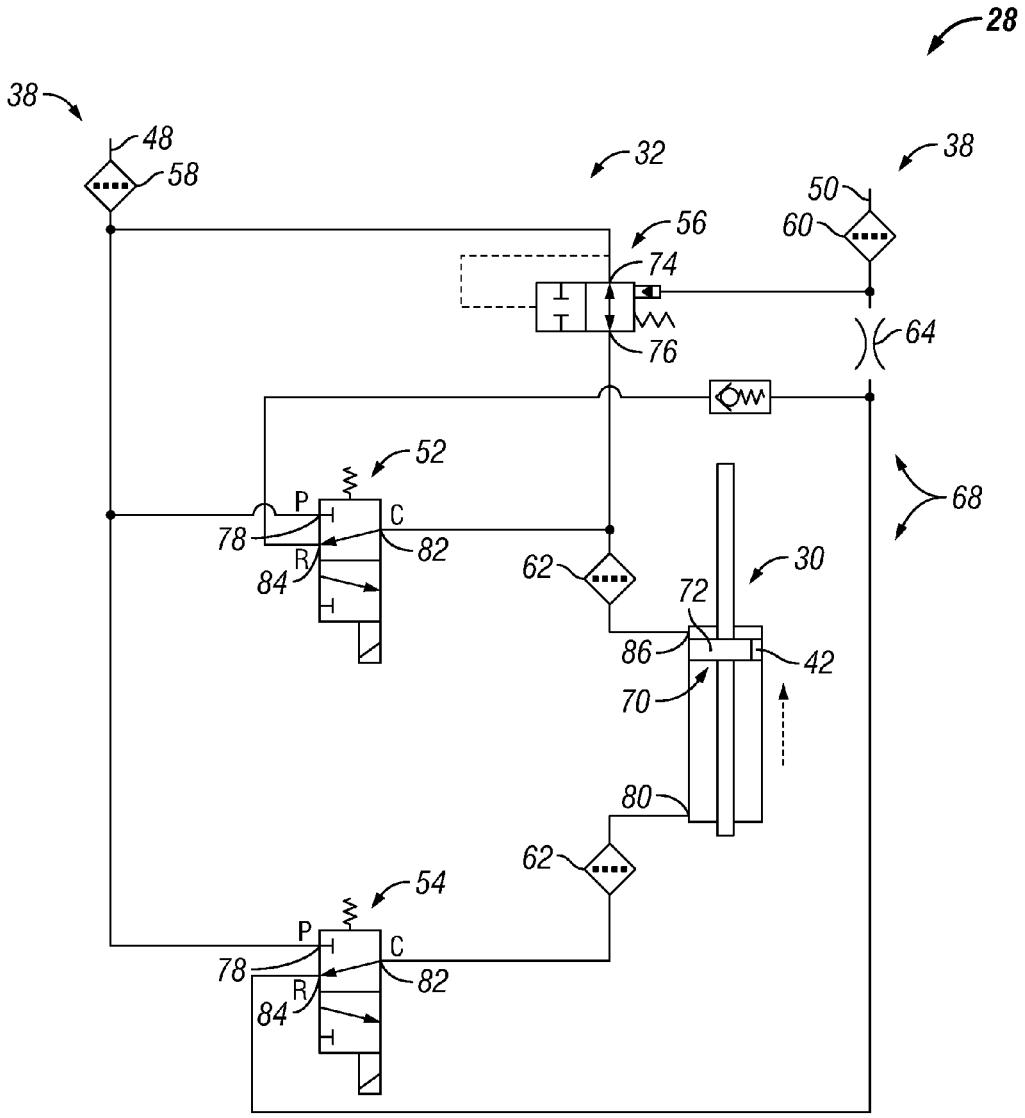
FIG. 7 is a schematic illustration of the control module in FIG. 3 but in another operational configuration, according to an embodiment of the present invention.

As discussed above, each control module 32 also comprises the hydraulic override system 68 which enables movement of the flow control valve actuator 70 to a desired operational position when no electrical power is available. By way of example, the hydraulic override system 68 may be designed to enable hydraulic actuation of the flow control valve piston 72 in one direction to an open flow position, as illustrated in FIG. 7. The override operation illustrated in FIG. 7 is performed using second hydraulic line 50 when no pressure is applied on first hydraulic line 48.

The pressurized hydraulic fluid in second hydraulic line 50 is communicated to the opening side/port 80 of the flow control valve 30 through port 84 and out through port 82 of electrically operated valve 54. This flow of hydraulic fluid through module valve 54 causes the flow control valve actuator 70 to move and thus to actuate the flow control valve 30 in an opening direction. In this embodiment, check valve 66 forms part of hydraulic override system 68 and prevents the pressurized actuating fluid in second hydraulic line 50 from communicating with the closing side/port 86 of flow control valve 30. The additional valve 56 also serves as part of the hydraulic override system 68 to enable venting of hydraulic fluid. For example, when using the hydraulic override system 68 to actuate the piston 72 (or other actuator) in the opening direction, the volume of hydraulic fluid on the closing side of the flow control valve 30 vents to first hydraulic line 48 through the additional valve 56 which is in its normally open position, as illustrated in FIG. 7.

The normally open valve 56 is illustrated as a hydraulically actuated valve, however other types of valves may be utilized to control the desired venting of hydraulic fluid to first hydraulic line 48. When valve 56 comprises a hydraulically actuated valve, the flow restrictor 64 assists valve 56 in the closing process. For example, without flow restrictor 64, pressurization of first hydraulic line 48 would cause communication of pressurized hydraulic fluid to second hydraulic line 50 through electrically operated valve 52 and check valve 66. The flow restrictor 64 enables establishment of a pressure differential between first hydraulic line 48 and second hydraulic line 50, thus enabling the normally open valve 56 to move to a closed position. It should be noted, however, the flow restrictor 64 can be placed at other locations and still serve the same purpose.

Examples of components and arrangements of components for each control module 32 have been illustrated to demonstrate the capability for providing individual control over flow control valves 30 in, for example, a multi-drop well application. However, the specific types of valves 52, 54, 56, check valves 66, flow restrictor 64, and other components may be changed and/or rearranged to suit other applications.

Figure 8:
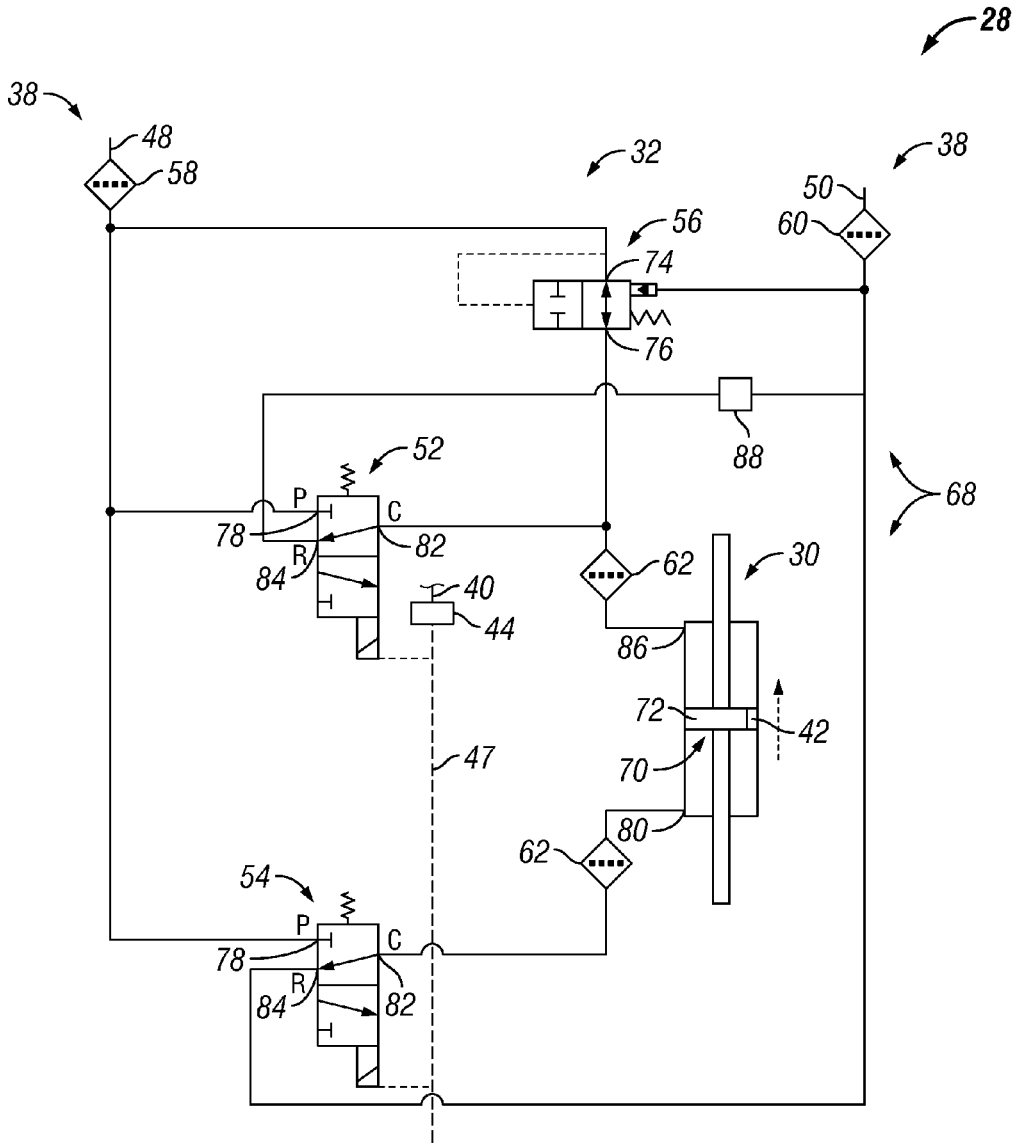
FIG. 8 is a schematic illustration of another example of the control module, according to an alternate embodiment of the present invention.

In FIG. 8, for example, the flow restrictor 64 and the check valve 66 have been replaced with a relief valve 88. A variety of relief valves are suitable to establish the desired pressure differential between first hydraulic line 48 and second hydraulic line 50 to ensure proper operation of normally open valve 56. The relief valve 88 also enables hydraulic override via the hydraulic override system 68 when no electricity is available for the solenoid valves or other types of electrically operated valves 52, 54. Backflow of hydraulic fluid through electrically operated valve 52 is prevented by relief valve 88 which performs a function similar to check valve 66 in the previous embodiment.

However, the components of control module 32 as well as the components of flow control valve assemblies 28 and overall well system 20 can be adjusted to accommodate a variety of structural, operational, and/or environmental parameters. For example, various combinations of solenoid valves and additional valves may be used in cooperation with two or more hydraulic lines to provide the desired control over individual flow control valves while also providing override functionality in the event electrical power is lost. Additionally, the number and arrangement of flow control valve assemblies 28 can vary substantially from one well application to another. The flow control valve assemblies can be utilized in both lateral and vertical wellbores to achieve the desired flow of fluid from surrounding well zones and/or into surrounding well zones. The relatively simple approach to providing control over individual flow control valves while retaining an override capability renders the system particularly amenable for use in multi-drop completion assemblies. The control modules 32 enable individualized flow control at multiple locations, e.g. 10 or more locations, via the multiple flow control valve assemblies.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for controlling flow in a wellbore, comprising:

a tubing string having a plurality of flow control valve assemblies, each flow control valve assembly comprising a flow control valve and a control module, the control module being coupled with a first hydraulic line, a second hydraulic line, and an electrical line;

each control module comprising a plurality of solenoid valves which respond to electric signals transmitted along the electrical line to control the opening and closing of the flow control valve via fluid passing through the first and second hydraulic lines, the control module further providing a hydraulic override to enable shifting of the flow control valve without requiring electric power supplied to the control module, the hydraulic override comprising a hydraulically actuated valve which is in a normally open position, the hydraulically actuated valve being held in a closed position by pressure applied via the first hydraulic line until a hydraulic override is desired.

2. The system is recited in claim 1, wherein each flow control valve comprises a flow control valve piston and a sensor to monitor flow control valve piston position.

3. The system is recited in claim 2, wherein the hydraulic override enables shifting of the flow control valve piston to an open flow position.

4. The system is recited in claim 1, wherein the fluid to activate the flow control valve flows through the plurality of solenoid valves.

5. The system as recited in claim 1, wherein the plurality of solenoid valves work in cooperation with a check valve and a flow restrictor coupled into the second hydraulic line, the check valve ensuring flow to open the flow control valve during hydraulic override.

6. The system as recited in claim 1, wherein the plurality of solenoid valves work in cooperation with a relief valve positioned to establish a pressure differential between the first hydraulic line and the second hydraulic line.

7. The system as recited in claim 1, wherein the plurality of solenoid valves comprises two solenoid valves.

8. The system as recited in claim 1, wherein the solenoid valves are controlled by specific electrical signals transmitted through the electrical line to enable selective control over individual flow control valve assemblies located at specific well zones.

9. The system as recited in claim 7, wherein one of the two solenoid valves controls fluid flow to shift the flow control valve piston toward an open position and the other of the two solenoid valves controls fluid flow to shift the flow control valve piston toward a closed position.

10. A system for controlling flow, comprising:

a flow control valve assembly configured for coupling into downhole well equipment, the flow control valve assembly comprising:

a flow control valve;

a control module, the control module comprising a plurality of electrically controlled valves which control flow of actuating fluid to the flow control valve; and a hydraulic override system to enable hydraulic actuation of the flow control valve to a predetermined position when the plurality of electrically controlled valves are not supplied with electricity, the hydraulic override system comprising a hydraulically actuated valve which is biased to a normally open position to enable flow-through of actuating fluid when a hydraulic override is desired.

11. The system as recited in claim 10, wherein the plurality of electrically controlled valves comprises two solenoid valves.

12. The system as recited in claim 11, further comprising a first hydraulic line, a second hydraulic line, and an electrical line all coupled to the control module.

13. The system as recited in claim 12, wherein the first hydraulic line delivers hydraulic fluid through at least one of the two solenoid valves to actuate the flow control valve.

14. The system as recited in claim 10, further comprising a second flow control valve assembly, wherein the flow control valve assembly and the second flow control valve assembly are coupled to a tubing string in a downhole, wellbore environment.

15. A method for controlling flow in a wellbore, comprising:

positioning a plurality of flow control valves along a well string located in a wellbore;

coupling a plurality of control modules to the plurality of flow control valves;

routing a pair of hydraulic lines and an electrical line along the wellbore to the plurality of control modules;

utilizing the pair of hydraulic lines and the electrical line to selectively actuate individual control modules of the plurality of control modules and corresponding flow control valves of the plurality of flow control valves; and providing each control module with a hydraulic override function which allows actuation of a corresponding flow control valve of the plurality of flow control valves to a desired position via shifting of a normally open, hydraulically actuated valve followed by only hydraulic input through at least one hydraulic line of the pair of hydraulic lines.

16. The method as recited in claim 15, further comprising monitoring the actuation position of each flow control valve; and selectively actuating each flow control valve to a desired flow rate.

17. The method as recited in claim 15, further comprising providing each control module with a plurality of solenoid valves, each solenoid valve being coupled to the pair of hydraulic lines and to the electrical line.

18. The method as recited in claim 17, further comprising providing each control module with a normally open, hydraulically operated valve coupled to the pair of hydraulic lines in a manner to facilitate use of only two solenoid valves for controlling actuation of the flow control valve while enabling hydraulic override capability.

* * * * *